US007326158B1

(12) United States Patent
Wang

(10) Patent No.: US 7,326,158 B1
(45) Date of Patent: Feb. 5, 2008

(54) BALL EXERCISER

(76) Inventor: Wen-Ching Wang, No. 168, Lane 14, 6 Rd., Nan-Yang Rd., Sha-Lu Chen, Taichung Hsien (TW)

( * ) Notice: Subject to any disclaimer, the term of this patent is extended or adjusted under 35 U.S.C. 154(b) by 0 days.

(21) Appl. No.: 11/593,907

(22) Filed: Nov. 7, 2006

(51) Int. Cl.
*A63B 21/00* (2006.01)
*A63B 43/02* (2006.01)
*A61H 15/00* (2006.01)

(52) U.S. Cl. ..... 482/132; 482/8; 482/51; 482/95; 601/120

(58) Field of Classification Search ..... 482/8, 482/51, 95, 96, 132, 141, 148, 907; 601/113, 601/120, 131; 473/596
See application file for complete search history.

(56) References Cited

U.S. PATENT DOCUMENTS 2,115,926 A * 5/1938 Hatton ..... 473/596
2,718,644 A * 9/1955 Barr ..... 441/56
4,641,839 A * 2/1987 Turner ..... 273/118 R
4,945,900 A * 8/1990 Masuda ..... 601/120
5,358,463 A * 10/1994 Fuentes ..... 482/141
5,766,112 A * 6/1998 Chuan ..... 482/44
6,190,292 B1 * 2/2001 Panes ..... 482/93
6,514,179 B1 * 2/2003 Yu ..... 482/44
6,773,377 B1 * 8/2004 Yu et al. ..... 482/45
6,964,635 B2 * 11/2005 Wang ..... 482/109
7,118,517 B1 * 10/2006 Hale ..... 482/140
7,175,573 B1 * 2/2007 Huang ..... 482/110

FOREIGN PATENT DOCUMENTS

EP 62455 A2 * 10/1982

* cited by examiner

*Primary Examiner*—Stephen R. Crow
*Assistant Examiner*—Victor K. Hwang
(74) *Attorney, Agent, or Firm*—Brinks Hofer Gilson & Lione

(57) ABSTRACT

A ball exerciser includes a deformable rolling body having an outer surrounding wall surface and at least one lateral mount wall, a rigid stationary coupling member secured to the lateral mount wall and having a stationary coupling end distal from the lateral mount wall, a movable coupling member having a movable coupling end disposed to be swivelable and frictionally rotatable relative to the stationary coupling end about a rolling axis, a grip including a grip segment which is spaced apart from the lateral mount wall and which is coupled to the movable coupling end so as to permit the grip segment to swivel with the movable coupling member.

13 Claims, 7 Drawing Sheets

BALL EXERCISER

BACKGROUND OF THE INVENTION

1. Field of the Invention

This invention relates to a ball exerciser, more particularly to a ball exerciser which can be used to perform various exercises.

2. Description of the Related Art

A conventional ball exerciser has a roughened outer surface or finger holes to permit holding by the user when it is used to do various exercises, such as swinging, lifting and rolling of the ball. However, the conventional ball exerciser is disadvantageous in that the roughened outer surface or finger holes are inconvenient to grasp by the user when used for rolling.

In U.S. Pat. No. 6,964,635 B2, the applicant disclosed an exercise apparatus that includes a ball body and two grip members disposed securely and respectively on two opposite sides of the ball body to facilitate grasping of the ball body by the user so that he/she can perform different exercises. However, since the grip members are fixed to the ball body, rolling of the ball body is obstructed when the user grips the grip members, thereby limiting the kinds of exercise modes that can be performed with the exercise apparatus.

SUMMARY OF THE INVENTION

The object of the present invention is to provide a ball exerciser which can meet different exercise requirements of a user and which can roll smoothly when gripped by the user.

According to this invention, the ball exerciser includes a deformable rolling body defining a rolling axis in a longitudinal direction, and having an outer surrounding wall surface which surrounds the rolling axis, and which includes uppermost and lowermost are as that are opposite to each other relative to the rolling axis, and that extend angularly about a center point in the rolling axis and in the longitudinal direction to respectively terminate at upper and lower lateral borderlines, and at least one lateral mount wall which extends in a direction transverse to the rolling axis to interconnect the upper and lower lateral borderlines. A stationary coupling member is made from a material more rigid than that of the rolling body, and is secured to the lateral mount wall. The stationary coupling member has a stationary coupling end which is distal from the lateral mount wall. A movable coupling member has a movable coupling end which is disposed to be swivelable and frictionally rotatable relative to the stationary coupling end about the rolling axis. A grip includes a grip segment which is disposed to be spaced apart from the lateral mount wall along the rolling axis, and which extends angularly about the center point and in the transverse direction to terminate at upper and lower anchoring ends that are respectively disposed adjacent to the upper and lower lateral borderlines, and that are coupled to the movable coupling end so as to permit the grip segment to swivel with the movable coupling member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
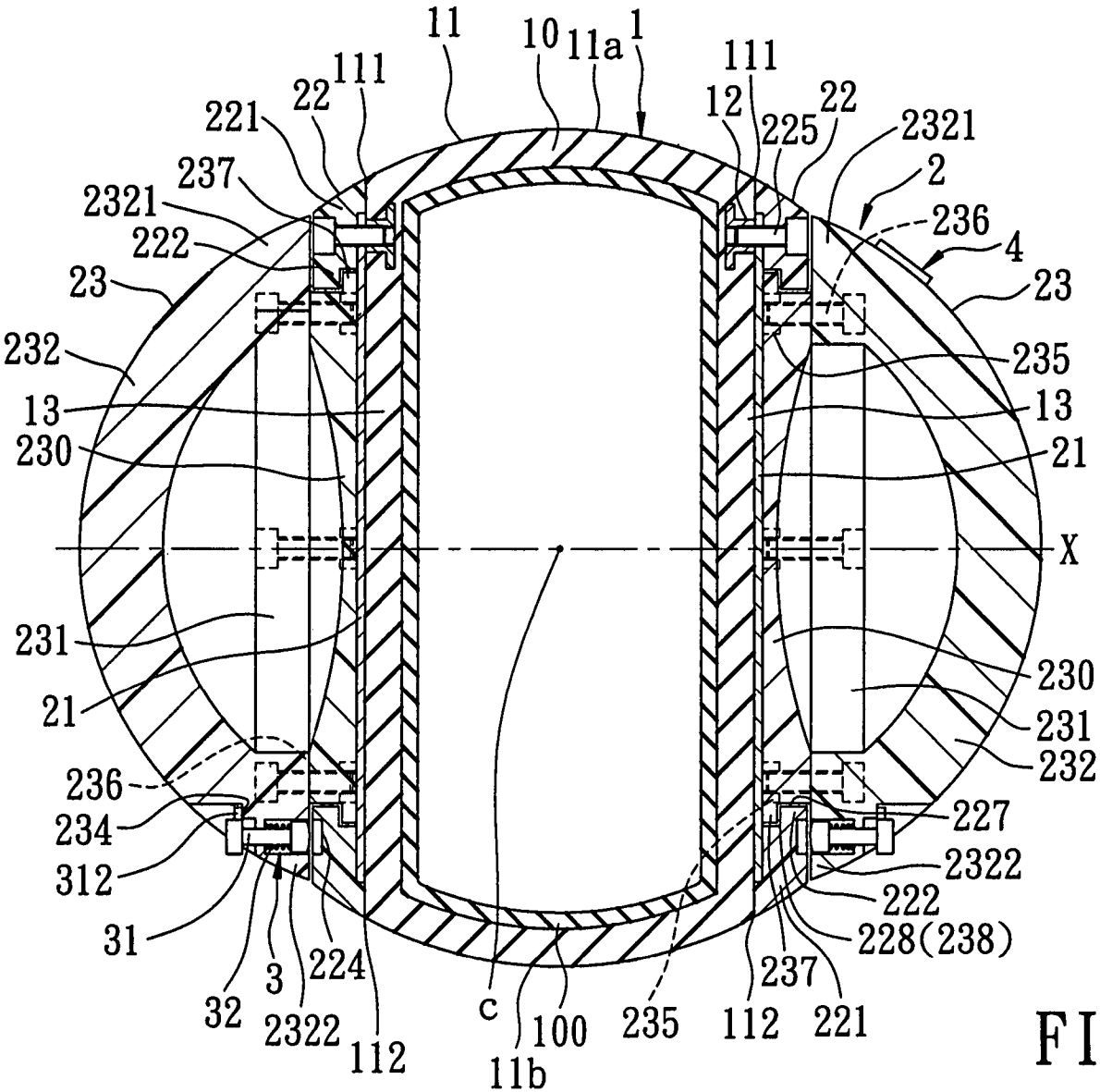
FIG. 1 is a sectional view of the first preferred embodiment of a ball exerciser according to this invention.

Before the present invention is described in greater detail, it should be noted that same reference numerals have been used to denote like elements throughout the specification.

Figure 2:
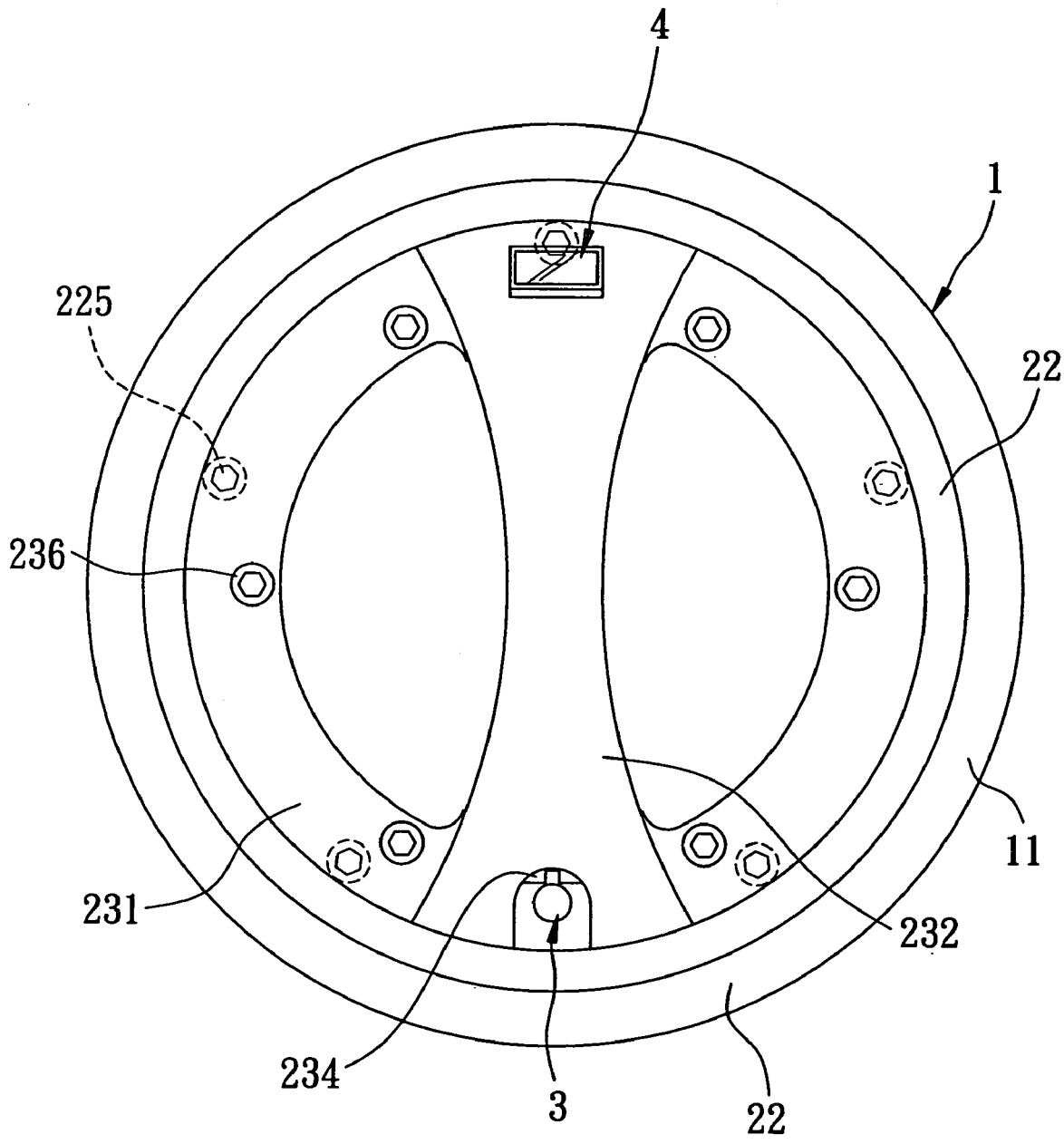
FIG. 2 is a schematic side view of the first preferred embodiment.
Figure 3:
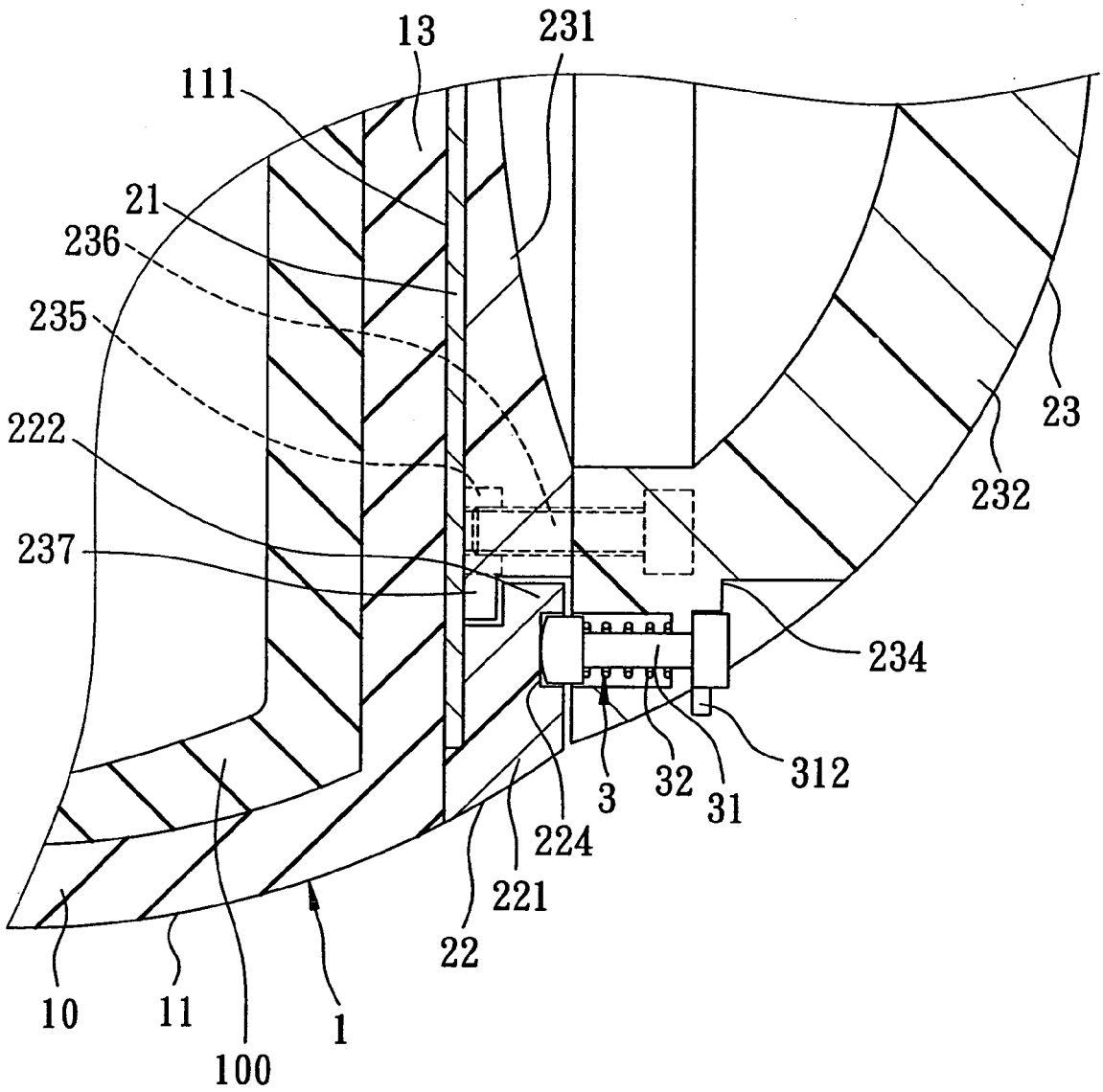
FIG. 3 is a fragmentary sectional view of the first preferred embodiment, showing a locking unit in a locking position.

Referring to FIGS. 1 to 3, the first preferred embodiment of a ball exerciser according to the present invention is shown to comprise a deformable rolling body 1, a grip unit 2, two locking units 3, and a display unit 4.

The rolling body 1 includes an inner bladder 100, an outer surrounding wall 10 surrounding the inner bladder 100 and having an outer surrounding wall surface 11, and a plurality of screw mounting seats 12 embedded in the outer surrounding wall 10. Alternatively, the rolling body 1 may include an inner bladder 100, a yarn layer enclosing the inner bladder, and an outer layer surrounding the yarn layer. Alternatively, the rolling body 1 may include an outer layer enclosing an inner bladder 100. The rolling body 1 may also be made from a rounded outer surrounding wall 10 which is inflatable so as to acquire a bouncing effect. Moreover, the weight of the rolling body 1 can be varied to meet different exercise requirements by changing the thickness of the outer surrounding wall 10, and by increasing/decreasing a filler therein.

The rolling body 1 defines a rolling axis (X) in a longitudinal direction such that the outer surrounding wall surface 11 surrounds the rolling axis (X). The outer surrounding wall surface 11 includes rounded uppermost and lowermost are as (11*a*, 11*b*) which are opposite to each other relative to the rolling axis (X), and which extend angularly about a center point (C) in the rolling axis (X) and in the longitudinal direction to respectively terminate at first and second upper lateral borderlines 111, and first and second lower lateral borderlines 112 that are opposite to the first upper and lower lateral borderlines 111, 112 in the longitudinal direction. The outer surrounding wall 10 has first and second lateral mount walls 13 which extend in a direction transverse to the rolling axis (X) to interconnect the first upper and lower lateral borderlines 111, 112 and the second upper and lower lateral borderlines 111,112, respectively.

The grip unit 2 includes first and second stationary coupling members 22, two reinforcement plates 21, first and second movable coupling members 230, and first and second grips 23.

The first and second stationary coupling members 22 are made from a material more rigid than that of the rolling body 1, and are secured to the first and second lateral mount walls 13, respectively, by screw fasteners 225 that are threadedly and respectively engaged with the screw mounting seats 12. Each of the first and second stationary coupling members 22 includes an annular body 221 surrounding the rolling axis (X), and an inner annular flange 222 to serve as a first stationary coupling end, which extends inwardly and radially from the annular body 221 to define an accommodation opening 227, and which is spaced apart from the first (second) lateral mount wall 13 in the longitudinal direction so as to form an annular inner shoulder surface 228 that confronts the first (second) lateral mount wall 13.

Each of the reinforcement plates 21 is interposed between the first (second) lateral mount wall 13 and the first (second) stationary coupling member 22, and is secured by the screw fasteners 225 so as to guard the first (second) lateral mount wall 13 against deformation.

Each of the first and second movable coupling members 230 is formed as a rotary body 230. The rotary body 230 has an annular peripheral rim which is configured to be insertable into the respective accommodation opening 227, and an outer annular flange 237 which serves as a first (second) movable coupling end 237 and which is disposed to extend outwardly and radially from the annular peripheral rim so as to form an annular outer shoulder surface 238 that confronts and that is in a rotatable friction engagement with the annular inner shoulder surface 228 about the rolling axis (X). Thus, each of the first and second grips 23 is swivelable with the first and second movable coupling members 230, respectively.

Each of the first and second grips 23 includes a loop mounting segment 231 which is connected securely to the respective rotary body 230 by screw fasteners 235,236, and a rounded grip segment 232 which is connected to the loop mounting segment 231, which is disposed to be spaced apart from the respective lateral mount wall 13 along the rolling axis (X), and which extends angularly about the center point (C) and in the transverse direction to terminate at upper and lower first (second) anchoring ends 2321,2322 that are respectively disposed adjacent to the first (second) upper and lower lateral borderlines 111,112. The outer surrounding wall surface 11 cooperates with the grip segments 232 of the first and second grips 23 to define a round profile of the ball exerciser.

Each of the locking units 3 includes a cavity 224 which is formed in the annular body 221 of the respective stationary coupling member 22, a latch bolt 31 which is disposed in and which is movable relative to the respective grip 23 between a locking position, where the latch bolt 31 is engaged in the cavity 224 so as to lock the grip 23 to the stationary coupling member 22, and an unlocking position, where the latch bolt 31 is disengaged from the cavity 224 so as to permit swiveling of the respective grip 23 relative to the respective stationary coupling member 22, and a biasing member 32 which is disposed to bias the latch bolt 31 toward the locking position. A holding unit includes an abutment 234 which is formed on the grip 23 and which faces outwardly, and a holding tab 312 which extends from the latch bolt 31 and which abuts against the abutment 234 so as to hold the latch bolt 31 in the unlocking position against the biasing action of the biasing member 32.

The display unit 4 is disposed on the grip segment 232 of one of the grips 23 for displaying the time, the number of times an exercise has been performed, and the amount of calories consumed during exercise. The display unit 4 can also generate an alarm sound.

In use, the user can grasp the grip segments 232 with both hands and place the rolling body 1 on a planar floor service to perform exercises, such as push-up exercises. In addition, the user can roll the rolling body 1 forwardly and rearwardly by rotating the grips 23 relative to the rolling body 1 while stretching and bending his/her body, thereby training muscles of the arms, waist, and abdomen.

Moreover, the user may bring the latch bolt 31 to the locking position to prevent swiveling of the grips 23 relative to the rolling body 1. Hence, the user can grasp the rolling body 1 firmly to perform lifting, swinging, striking exercises for training muscles of the arms, waist, chest, abdomen, and back.

Figure 4:
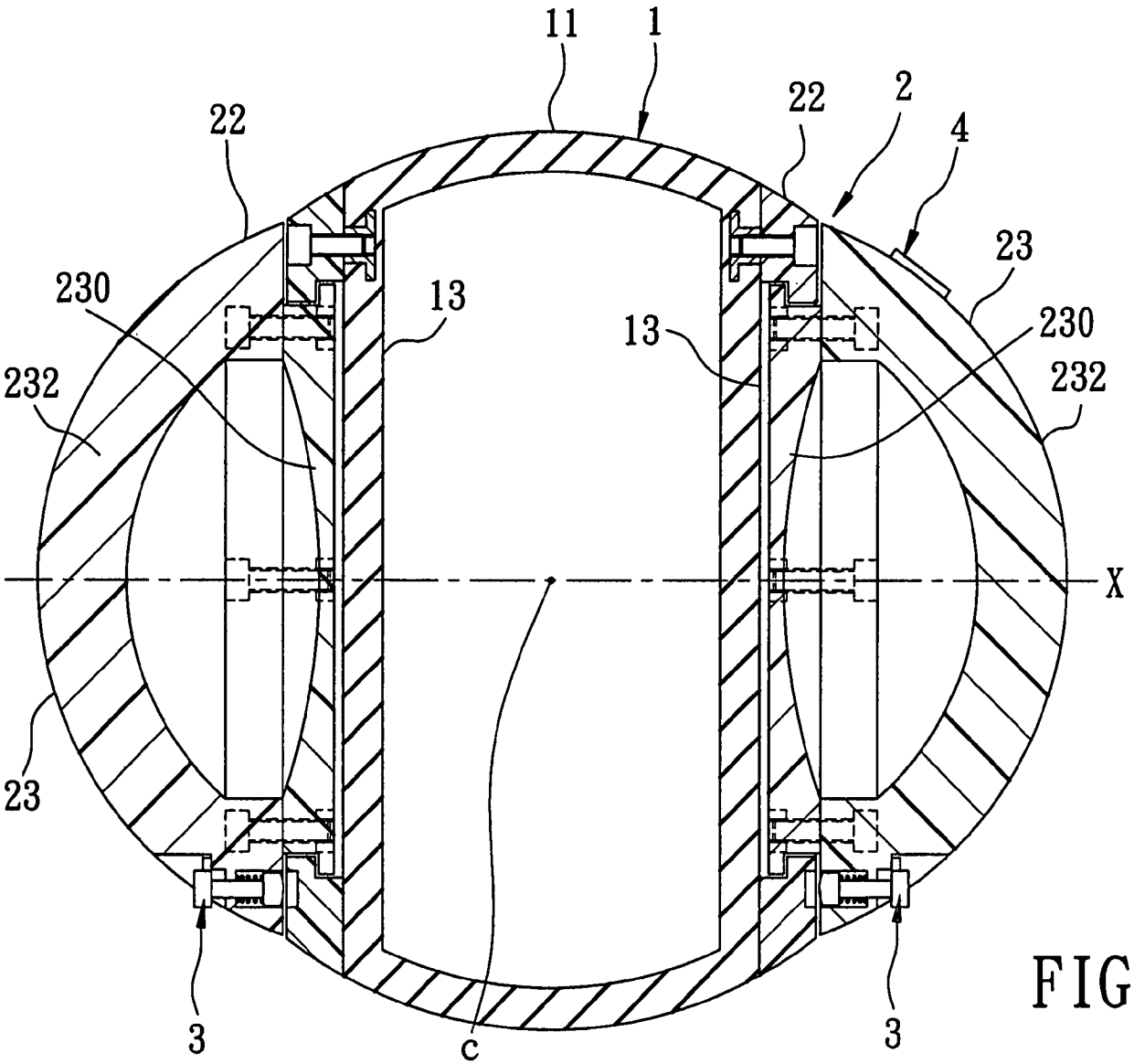
FIGS. 4 to 7 are respectively sectional views of the second to fifth preferred embodiments of a ball exerciser according to this invention.

Referring to FIG. 4, the second preferred embodiment of a ball exerciser according to this invention is shown to be similar to the first embodiment in construction and function, except that the rolling body 1 has an integrally formed structure, and the first and second stationary coupling members 22 are mounted on the first and second lateral mount walls 13, respectively, without the reinforcement plates interposed therebetween.

Figure 5:
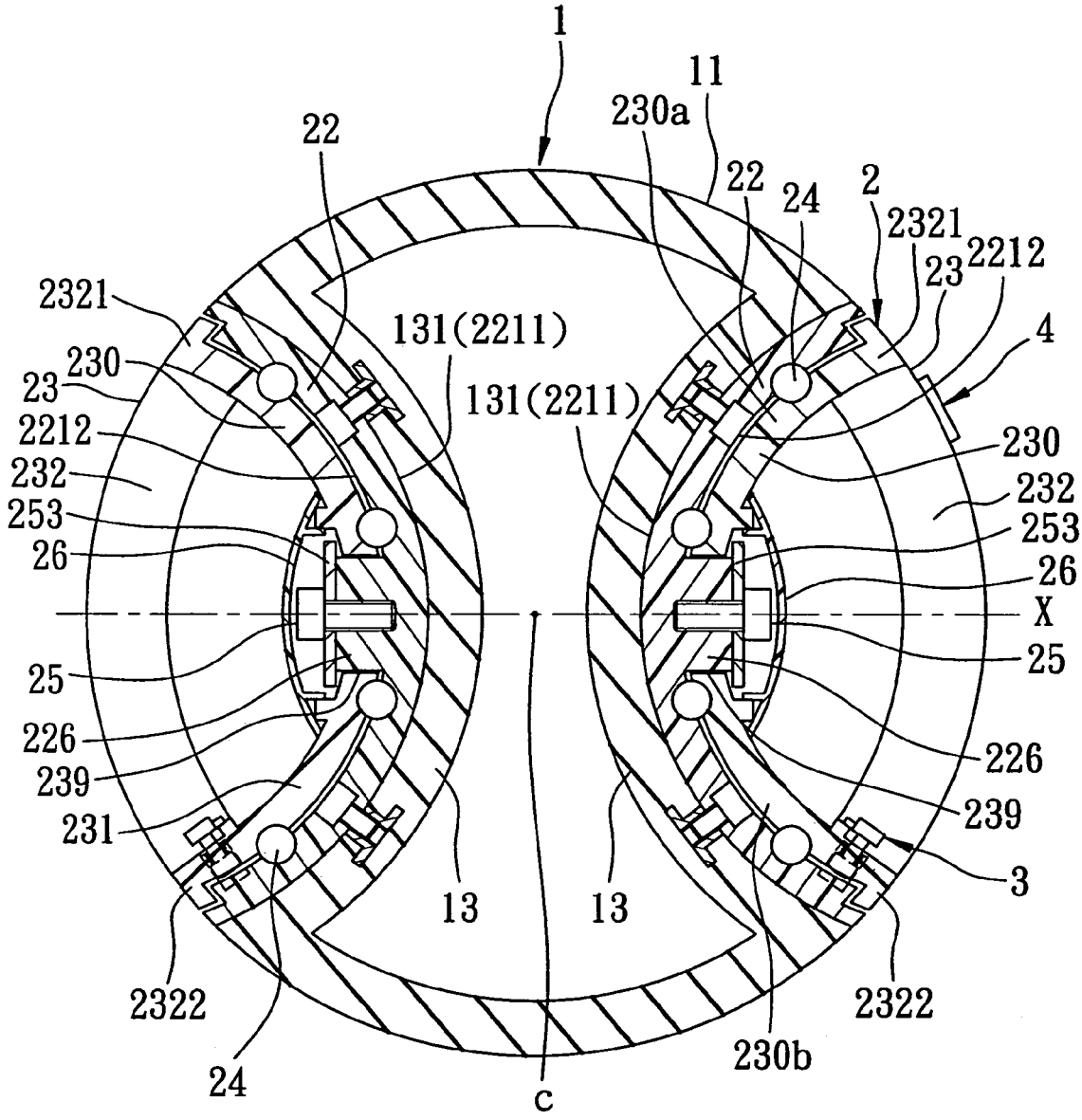

Referring to FIG. 5, the third preferred embodiment of a ball exerciser according to this invention is shown to be similar to the previous embodiments in construction and function. In the third embodiment, each of the first and second lateral mount walls 13 is concaved toward the center point (C) so as to form an outwardly facing concave surface 131. Each of the first and second stationary coupling members 22 is configured to extend along and be compliant with the outwardly facing concave surface 131 so as to form a first (second) concave major wall. The first (second) concave major wall has a first (second) convex major surface 2211 which is compliantly engaged with the respective outwardly facing concave surface 131, and a first (second) concave major surface 2212 which is opposite to the first (second) convex major surface 2211 to serve as the first (second) stationary coupling end. Each of the first and second movable coupling members 230 is configured to extend from the respective upper and lower anchoring ends 2321,2322 towards both the rolling axis (X) and the center point (C) to form upper and lower supporting walls (230*a*,230*b*), respectively. The upper and lower supporting walls (230*a*,230*b*) respectively terminate at upper and lower inner edges that cooperatively define an axial passage 239 along the rolling axis (X), and confront the first (second) concave major surface 2212 to serve as the first (second) movable coupling end. A plurality of anti-frictional rolling members 24 are interposed between the first (second) concave major surface 2212 and the upper supporting wall (230*a*) and between the first (second) concave major surface 2212 and the lower supporting wall (230*b*) so as to reduce the friction force that is generated during the swiveling of the upper and lower supporting walls (230*a*,230*b*) relative to the first (second) concave major surface 2212.

Each of the first and second stationary coupling members 22 has a guarding unit which includes amount 226 which extends from the first (second) concave major surface 2212 along the rolling axis (X) and which passes through the axial passage 239 and beyond the upper and lower inner edges and to terminate at an anchored end, and a guarding plate 253 which is secured to the anchored end by a fastener 25, and which extends in the transverse direction so as to guard against shifting of the first (second) movable coupling member 230 away from the first (second) concave major surface 2212 during the swiveling movement of the upper and lower supporting walls (230*a*,230*b*). A decorative cover 26 is disposed to cover the fastener 25.

Figure 6:
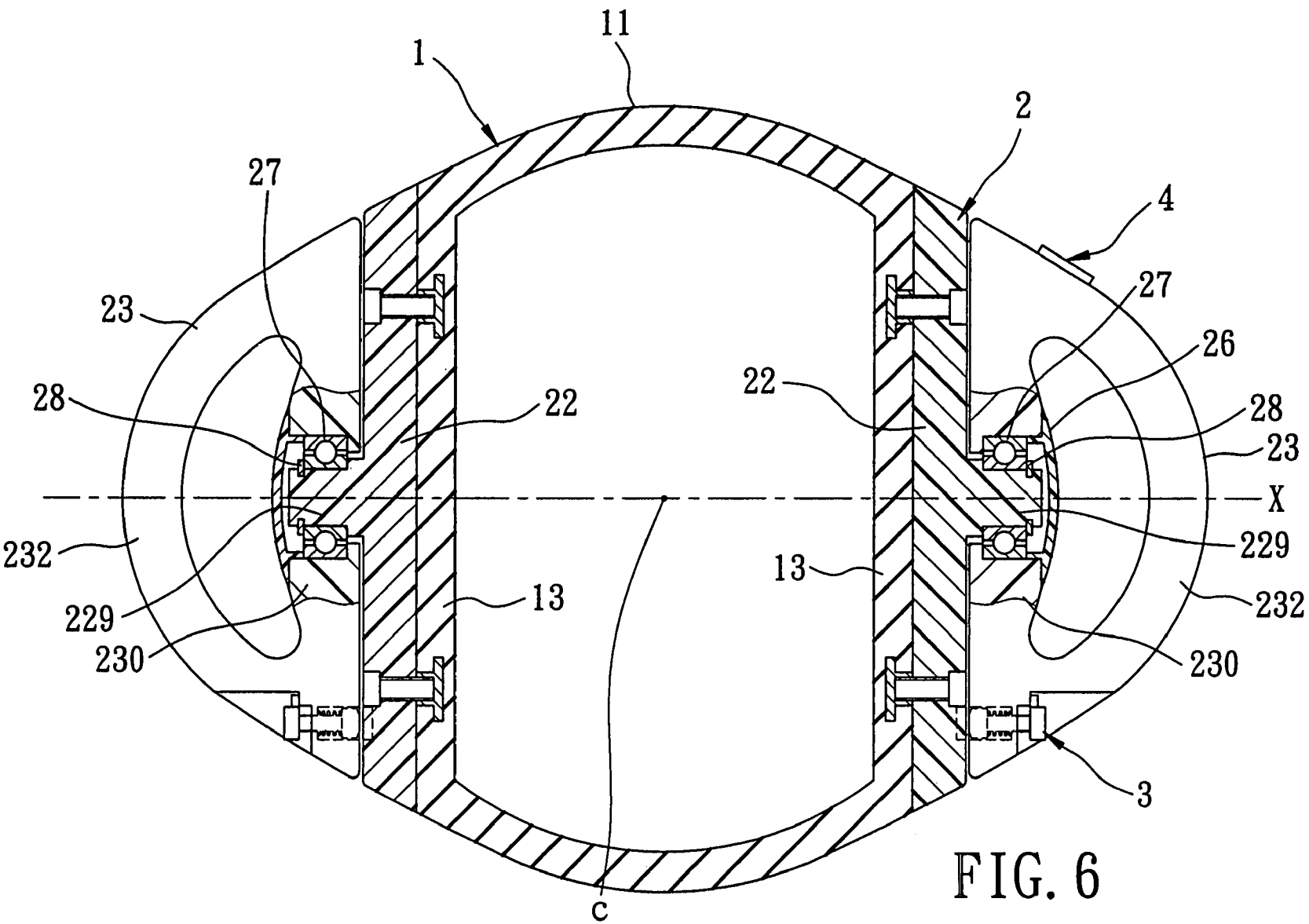

Referring to FIG. 6, the fourth preferred embodiment of a ball exerciser according to this invention is shown to be similar to the previous embodiments in construction and function. In the fourth embodiment, each of the first and second lateral mount walls 13 has an outwardly facing straight surface which extends in the transverse direction. Each of the first and second stationary coupling members 22 has a straight major wall which is configured to extend along and be compliant with the outwardly facing straight surface, and a coupling shaft 229 which extends from the straight major wall along the rolling axis (X) to serve as the first (second) stationary coupling end. Each of the first and second movable coupling members 230 has a straight major surface which is disposed to confront the straight major wall, and an inner peripheral wall which extends to surround the respective coupling shaft 229 so as to serve as the first (second) movable coupling end, and which is journalled on the coupling shaft 229. An anti-frictional bearing member 27 is interposed between the inner peripheral wall and the coupling shaft 229, and is retained by a C-shaped snap fastener 28.

Figure 7:
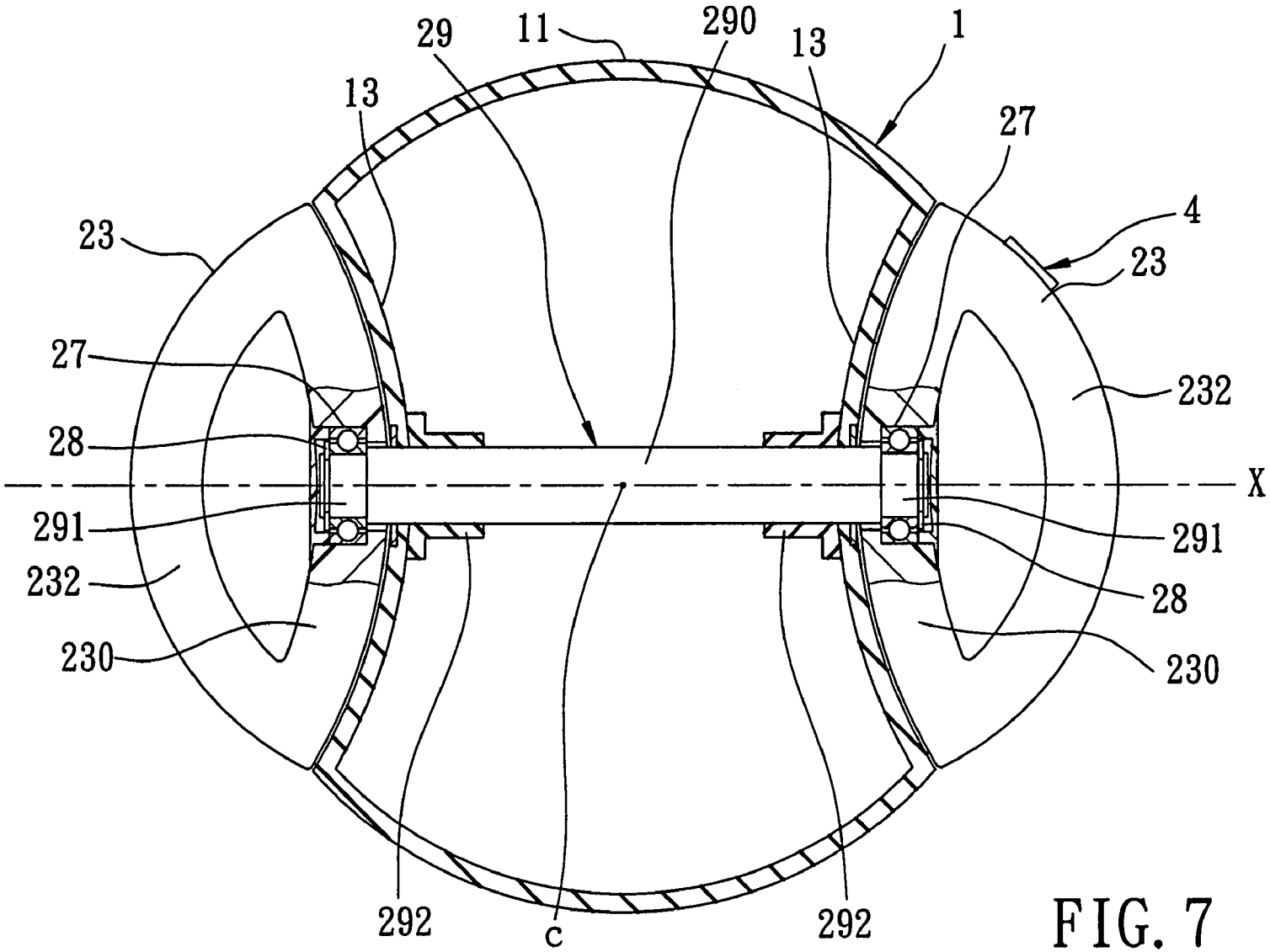

Referring to FIG. 7, the fifth preferred embodiment of a ball exerciser according to this invention is shown to be similar to the previous embodiments in construction and function. In the fifth embodiment, the first and second stationary coupling members 29 are integrally formed as a shaft 290 which extends through the rolling body 1 along the rolling axis (X) to terminate at first and second shaft ends 291 that are respectively disposed outwardly of the first and second lateral mount walls 13, and that respectively serve as the first and second stationary coupling ends. Each of the first and second movable coupling members 230 has an inner peripheral wall which extends along the rolling axis (X) to serve as the first (second) movable coupling end and which is journalled on the first (second) shaft end 291. An anti-frictional bearing member 27 is interposed between the inner peripheral wall and the first (second) shaft end 291, and is retained by a C-shaped snap fastener 28. Two sleeves 292 are sleeved on the shaft 290 adjacent to the first and second shaft ends 291, and are in air-tight engagement with the first and second lateral mount walls 13, respectively, so as to achieve firm coupling of the shaft 290 to the rolling body 1.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A ball exerciser comprising:

a deformable rolling body defining a rolling axis in a longitudinal direction, and having an outer surrounding wall surface which surrounds the rolling axis, and which includes uppermost and lowermost areas that are opposite to each other relative to the rolling axis, and that extend angularly about a center point in the rolling axis and in the longitudinal direction to respectively terminate at first upper and lower lateral borderlines, and a first lateral mount wall which extends in a direction transverse to the rolling axis to interconnect said first upper and lower lateral borderlines;

a first stationary coupling member which is made from a material more rigid than that of said rolling body, and which is secured to said first lateral mount wall, said first stationary coupling member having a first stationary coupling end which is distal from said first lateral mount wall;

a first movable coupling member having a first movable coupling end which is disposed to be swivelable and frictionally rotatable relative to said first stationary coupling end about the rolling axis; and a first grip including a first grip segment which is disposed to be spaced apart from said first lateral mount wall along the rolling axis, and which extends angularly about the center point and in the transverse direction to terminate at upper and lower first anchoring ends that are respectively disposed adjacent to said first upper and lower lateral borderlines, and that are coupled to said first movable coupling end so as to permit said first grip segment to be swiveling with said first movable coupling member.

2. The ball exerciser of claim 1, wherein said uppermost and lowermost are as of said outer surrounding wall surface further extend to terminate at second upper and lower lateral borderlines which are opposite to said first upper and lower lateral borderlines in the longitudinal direction, said rolling body having a second lateral mount wall which extends in the transverse direction to interconnect said second upper and lower lateral borderlines;

said ball exerciser further comprising:

a second stationary coupling member which is made from a material more rigid than that of said rolling body, and which is secured to said second lateral mount wall, said second stationary coupling member having a second stationary coupling end which is distal from said second lateral mount wall;

a second movable coupling member having a second movable coupling end which is disposed to be swivelable and frictionally rotatable relative to said second stationary coupling end about the rolling axis; and a second grip including a second grip segment which is disposed to be spaced apart from said second lateral mount wall along the rolling axis, and which extends angularly about the center point and in the transverse direction to terminate at upper and lower second anchoring ends that are respectively disposed adjacent to said second upper and lower lateral borderlines, and that are coupled to said second movable coupling end so as to permit said second grip segment to swivel with said second movable coupling member.

3. The ball exerciser of claim 1, wherein said first stationary coupling member includes an annular body surrounding the rolling axis, and an inner annular flange to serve as said first stationary coupling end, which extends inwardly and radially from said annular body to define a first accommodation opening, and which is spaced apart from said first lateral mount wall in the longitudinal direction so as to form an annular inner shoulder surface that confronts said first lateral mount wall, said first movable coupling member being formed as a rotary body which has an annular peripheral rim that is configured to be insertable into said accommodation opening, and an outer annular flange disposed to extend outwardly and radially from said annular peripheral rim so as to form an annular outer shoulder surface which confronts and which is in a rotatable friction engagement with said annular inner shoulder surface about the rolling axis so as permit said first grip segment to swivel with said first movable coupling member.

4. The ball exerciser of claim 3, further comprising a reinforcement plate which is interposed between said first lateral mount wall and said first stationary coupling member to guard said first lateral mount wall against deformation.

5. The ball exerciser of claim 1, further comprising a locking unit which is disposed to releasably lock said first movable coupling member to said first stationary coupling member such that the swiveling of said first grip relative to said first stationary coupling member can be prevented.

6. The ball exerciser of claim 5, wherein said locking unit includes a cavity which is formed in said first stationary coupling member, a latch bolt which is disposed in and which is movable relative to said first grip between a locking position, where said latch bolt is engaged in said cavity so as to lock said first grip to said first stationary coupling member, and an unlocking position, where said latch bolt is disengaged from said cavity so as to permit swiveling of said first grip relative to said first stationary coupling member, and a biasing member which is disposed to bias said latch bolt toward the locking position.

7. The ball exerciser of claim 6, further comprising a holding unit which is disposed to hold said latch bolt in the unlocking position against biasing action of said biasing member.

8. The ball exerciser of claim 1, wherein said first lateral mount wall is concaved toward the center point so as to form an outwardly facing concave surface, said first stationary coupling member being configured to extend along and be compliant with said outwardly facing concave surface so as to form a first concave major wall which has a first convex major surface compliantly engaged with said outwardly facing concave surface, and a first concave major surface that is opposite to said first convex major surface and that serves as said first stationary coupling end, said first movable coupling member being configured to extend from said upper and lower anchoring ends towards both the rolling axis and the center point to form upper and lower supporting walls, respectively, which terminate at upper and lower inner edges that cooperatively define an axial passage along the rolling axis, said upper and lower supporting walls confronting said first concave major surface, and serving as said first movable coupling end, said ball exerciser further comprising a plurality of anti-frictional rolling members which are interposed between said first concave major surface and said upper supporting wall and between said first concave major surface and said lower supporting wall so as to reduce a friction force that is generated during swiveling of said upper and lower supporting walls relative to said first concave major surface.

9. The ball exerciser of claim 8, wherein said first stationary coupling member has a guarding unit which includes a mount that extends from said first concave major surface along the rolling axis and that passes through said axial passage and beyond said upper and lower inner edges and to terminate at an anchored end, and a guarding plate which is secured to said anchored end, and which extends in the transverse direction so as to guard against shifting of said first movable coupling member away from said first concave major surface during the swiveling movement of said upper and lower supporting walls.

10. The ball exerciser of claim 1, wherein said first lateral mount wall has an outwardly facing straight surface which extends in the transverse direction, said first stationary coupling member having a straight major wall which is configured to extend along and be compliant with said outwardly facing straight surface, and a coupling shaft which extends from said straight major wall along the rolling axis to serve as said first stationary coupling end, said first movable coupling member having a straight major surface which is disposed to confront said straight major wall, and an inner peripheral wall which extends to surround said coupling shaft so as to serve as said first movable coupling end and which is journalled on said coupling shaft, said ball exerciser further comprising an anti-frictional bearing member which is interposed between said inner peripheral wall and said coupling shaft.

11. The ball exerciser of claim 1, wherein said first stationary coupling member includes a shaft which extends through said rolling body along the rolling axis to terminate at a first shaft end that is disposed outwardly of said first lateral mount wall and that serves as said first stationary coupling end, said first movable coupling member having an inner peripheral wall which extends along the rolling axis to serve as said first movable coupling end and which is journalled on said first shaft end, said ball exerciser further comprising an anti-frictional bearing member which is interposed between said inner peripheral wall and said first shaft end.

12. The ball exerciser of claim 1, further comprising a display unit disposed on said first grip segment for displaying time, a number of times an exercise has been performed, and an amount of calories consumed during exercise.

13. The ball exerciser of claim 1, wherein said uppermost and lowermost are as and said first grip segment are rounded so as to define a round profile of said ball exerciser.

* * * * *